US009180662B2

(12) United States Patent
Yamada

(10) Patent No.: US 9,180,662 B2
(45) Date of Patent: Nov. 10, 2015

(54) LIQUID EJECTING APPARATUS AND HEAD UNIT

(71) Applicant: Seiko Epson Corporation, Tokyo (JP)

(72) Inventor: Tomonori Yamada, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/516,935

(22) Filed: Oct. 17, 2014

(65) Prior Publication Data

US 2015/0138267 A1 May 21, 2015

(30) Foreign Application Priority Data

Nov. 21, 2013 (JP) ..... 2013-241004

(51) Int. Cl.
*B41J 2/45* (2006.01)
*B41J 29/38* (2006.01)
*B41J 2/045* (2006.01)

(52) U.S. Cl.
CPC ..... *B41J 2/04541* (2013.01); *B41J 2/04581* (2013.01)

(58) Field of Classification Search
USPC ..... 347/17
See application file for complete search history.

(56) References Cited

U.S. PATENT DOCUMENTS

| | | | | |
|---|---|---|---|---|
| 8,382,224 | B2 | 2/2013 | Tabata et al. | |
| 8,632,148 | B2 | 1/2014 | Tabata et al. | |
| 2004/0119770 | A1* | 6/2004 | Tamura | 347/19 |
| 2006/0044337 | A1* | 3/2006 | Takata | 347/14 |
| 2007/0242427 | A1* | 10/2007 | Yamamoto et al. | 361/689 |
| 2014/0098150 | A1 | 4/2014 | Tabata et al. | |

FOREIGN PATENT DOCUMENTS

JP 2011-005733 A 1/2011

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

A liquid ejecting apparatus includes an original drive signal generation section that generates an original drive signal, a signal modulation section that modulates the original drive signal and generates a modulation signal, a signal amplification section that amplifies the modulation signal and generates an amplification modulation signal, a signal conversion section that converts the amplification modulation signal into a drive signal, a piezoelectric element that deforms by the drive signal, a cavity that expands or contracts due to deformation of the piezoelectric element, a nozzle that communicates with the cavity and ejects a liquid in response to increase and decrease of a pressure inside the cavity, and a temperature detection section that detects a temperature of the signal conversion section.

6 Claims, 10 Drawing Sheets

LIQUID EJECTING APPARATUS AND HEAD UNIT

The entire disclosure of Japanese Patent Application No. 2013-241004, filed Nov. 21, 2013 is expressly incorporated by reference herein.

BACKGROUND

1. Technical Field

The present invention relates to a liquid ejecting apparatus and a head unit including a head which is provided in the liquid ejecting apparatus.

2. Related Art

As a liquid ejecting apparatus such as an ink jet printer, there is a known apparatus which adopts a piezoelectric element as an actuator to eject ink droplets. In order to drive the piezoelectric element, it is necessary to apply a drive signal having amplitude of several tens of volts at the peak value. In the related art, an analog amplification circuit having a bipolar transistor subjected to a push-pull connection is mounted on a drive substrate which generates the drive signal. However, there has been a disadvantage in that a heat sink for dissipating heat is necessary on account of unfavorable efficiency of power conversion and a large calorific value.

The inventors, taking the above-described problem into consideration, have proposed to use a digital amplification circuit having more excellent efficiency of power conversion than that of the analog amplification circuit (for example, JP-A-2011-5733). The digital amplification circuit adopts a pulse modulation technology, thereby having more excellent efficiency of power conversion than that of the analog amplification circuit and making it possible to suppress heat generation.

However, there is a disadvantage in that heat generation of a level which is not negligible occurs even though a digital amplification circuit is adopted. The digital amplification circuit is generally configured to have a switching element and a coil (a low-pass filter), but when there is a need to supply electrical charges to a large number of piezoelectric elements such as the low-pass filters and to apply voltages to eject liquid droplets by driving the piezoelectric element, the coil receives an extremely large load. The heat generation of a coil particularly becomes a major disadvantage in a line printer and the like having a large number of nozzles.

The heat generation of a coil causes the resistance value and the inductance of the coil to change, thereby resulting in changes of characteristics of a signal which is restored through the coil. When the characteristics of the signal change, an operation of a piezoelectric element which has been driven based on the signal changes in response to a temperature change of the coil. Thus, a pressure change of a cavity which has changed by the operation of the piezoelectric element also changes. Eventually, there are possibilities that the amount of liquid droplets ejected from nozzles may change, images printed on a medium may change, and deterioration of image quality may be caused. There is another possibility that when the temperature is excessively high, long-term quality of components (for example, a capacitor) which are arranged together with the coil may be influenced.

SUMMARY

An advantage of some aspects of the invention is to provide a liquid ejecting apparatus and a head unit in which the change of the amount of liquid droplets ejected from a nozzle in response to a temperature change can be avoided.

(1) According to an aspect of the invention, there is provided a liquid ejecting apparatus including an original drive signal generation section that generates an original drive signal, a signal modulation section that modulates the original drive signal and generates a modulation signal, a signal amplification section that amplifies the modulation signal and generates an amplification modulation signal, a signal conversion section that converts the amplification modulation signal into a drive signal, a piezoelectric element that deforms by the drive signal, a cavity that expands or contracts due to deformation of the piezoelectric element, a nozzle that communicates with the cavity and ejects a liquid in response to the increase and decrease of a pressure inside the cavity, and a temperature detection section that detects the temperature of the signal conversion section.

In this case, ejecting stability can be achieved and damage to components can be avoided by causing the temperature detection section to detect the temperature of the signal conversion section. Regarding the ejecting stability, for example, distortion of the drive signal can be corrected in response to the temperature by detecting the temperature. Therefore, it is possible to avoid the change of the amount of liquid droplets ejected from the nozzle caused by the temperature change and to avoid deterioration of the quality of a generated product. Regarding the avoidance of damage to components, for example, it is possible to determine that the components are used under a high temperature by detecting the temperature. In this case, the generation of the drive signal is stopped so as to be able to avoid negative influence (or damage to the components when the temperature is excessively high) to long-term quality of the components (for example, a capacitor configuring a low-pass filter). Accordingly, it is possible to avoid deterioration of the long-term quality (for example, life duration) of a liquid ejecting apparatus.

(2) According to the aspect of the invention, the length of a path which electrically connects between the signal conversion section and the temperature detection section may be shorter than the length of a path which electrically connects between the signal conversion section and the signal amplification section.

In this case, noise of other signals caused by an operation of the signal amplification section can be removed within a possible range by shortening the length of a path between the signal conversion section and the temperature detection section. Moreover, it is possible to decrease the influence of other heat generation sources (for example, a switching element) in the signal amplification section within a possible range.

(3) According to the aspect of the invention, an operation of any one among the original drive signal generation section, the signal modulation section, and the signal amplification section may be stopped in response to the temperature detected by the temperature detection section.

In this case, an operation of any one among the original drive signal generation section, the signal modulation section, and the signal amplification section is stopped when the detected temperature exceeds a predetermined temperature which is based on a rated temperature range, for example. Therefore, the temperature is lowered by stopping any one thereamong, and thus, it is possible to prevent negative influence and the like with respect to the long-term quality of the components (for example, a capacitor configuring the low-pass filter).

(4) According to the aspect of the invention, an operation of any one among the original drive signal generation section, the signal modulation section, and the signal amplification section may be corrected in response to the temperature detected by the temperature detection section.

In this case, an operation of any one among the original drive signal generation section, the signal modulation section, and the signal amplification section is corrected in response to the detected temperature, and thus, the distortion of the drive signal can be corrected. Accordingly, it is possible to avoid the change of the amount of liquid droplets ejected from the nozzle caused by the temperature change and to avoid deterioration of the quality of a generated product. Here, the correction of the operation of the original drive signal generation section denotes that a waveform of the original drive signal is changed, for example. In other words, a correction of emphasizing an attenuated frequency with the original drive signal is performed (pre-emphasis) in accordance with the characteristics of the frequency attenuation of the drive signal caused by the temperature change. The correction of the operation of the signal modulation section denotes that a modulation frequency is lowered, for example. Moreover, the correction of the signal amplification section denotes that an amplification factor is changed (voltage is lowered) so as to achieve a decrease of the load, for example. According to the corrections thereof, it is possible to decrease the distortion of the drive signal due to the change of the inductance accompanied by the temperature change.

(5) According to the aspect of the invention, there may be a plurality of piezoelectric elements, and the drive signal may be applied to the plurality of piezoelectric elements.

In this case, when the drive signal is applied to the plurality of piezoelectric elements, a large number of the piezoelectric elements are influenced by the distortion of the drive signal caused by the temperature change, thereby greatly influencing the quality of a generated product (for example, a printed material). According to the liquid ejecting apparatus, the great influence with respect to the quality of such a generated product can be avoided, and thus, it is possible to achieve a remarkable effect thereof.

(6) According to the aspect of the invention, the liquid ejecting apparatus may be a line head printer.

In this case, in a case of the line head printer, there is a need to simultaneously drive a plurality of the nozzles arranged in a line, and thus, the quality of the generated product is greatly influenced by the temperature change as described above. According to the liquid ejecting apparatus, the great influence with respect to the quality of such a generated product can be avoided, and thus, it is possible to achieve a remarkable effect compared to a serial printer which does not need to be simultaneously driven.

(7) According to the aspect of the invention, the physical straight-line distance between the signal conversion section and the temperature detection section may be shorter than the physical straight-line distance between the signal conversion section and the signal amplification section.

In this case, noise of other signals caused by the operation of the signal amplification section can be removed within the possible range by shortening the physical straight-line distance between the signal conversion section and the temperature detection section.

(8) According to another aspect of the invention, there is provided a head unit including a piezoelectric element that deforms by a drive signal, a cavity that expands or contracts due to deformation of the piezoelectric element, and a nozzle that communicates with the cavity and ejects a liquid in response to the increase and decrease of a pressure inside the cavity. The piezoelectric element receives the drive signal which is generated by a signal conversion section, and a waveform of the drive signal is adjusted in response to the temperature of the signal conversion section which is detected by a temperature detection section.

In this case, in the head unit, the drive signal having the waveform adjusted in response to the temperature of the signal conversion section which is detected by a temperature detection section is received, and thus, it is possible to avoid the change of the amount of liquid droplets ejected from the nozzle caused by the temperature change and to avoid deterioration of the quality of a generated product.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Configuration of Printing System

A configuration applied to a liquid ejecting-type printing apparatus will be described as an embodiment of a liquid ejecting apparatus according to the invention.

Figure 1:
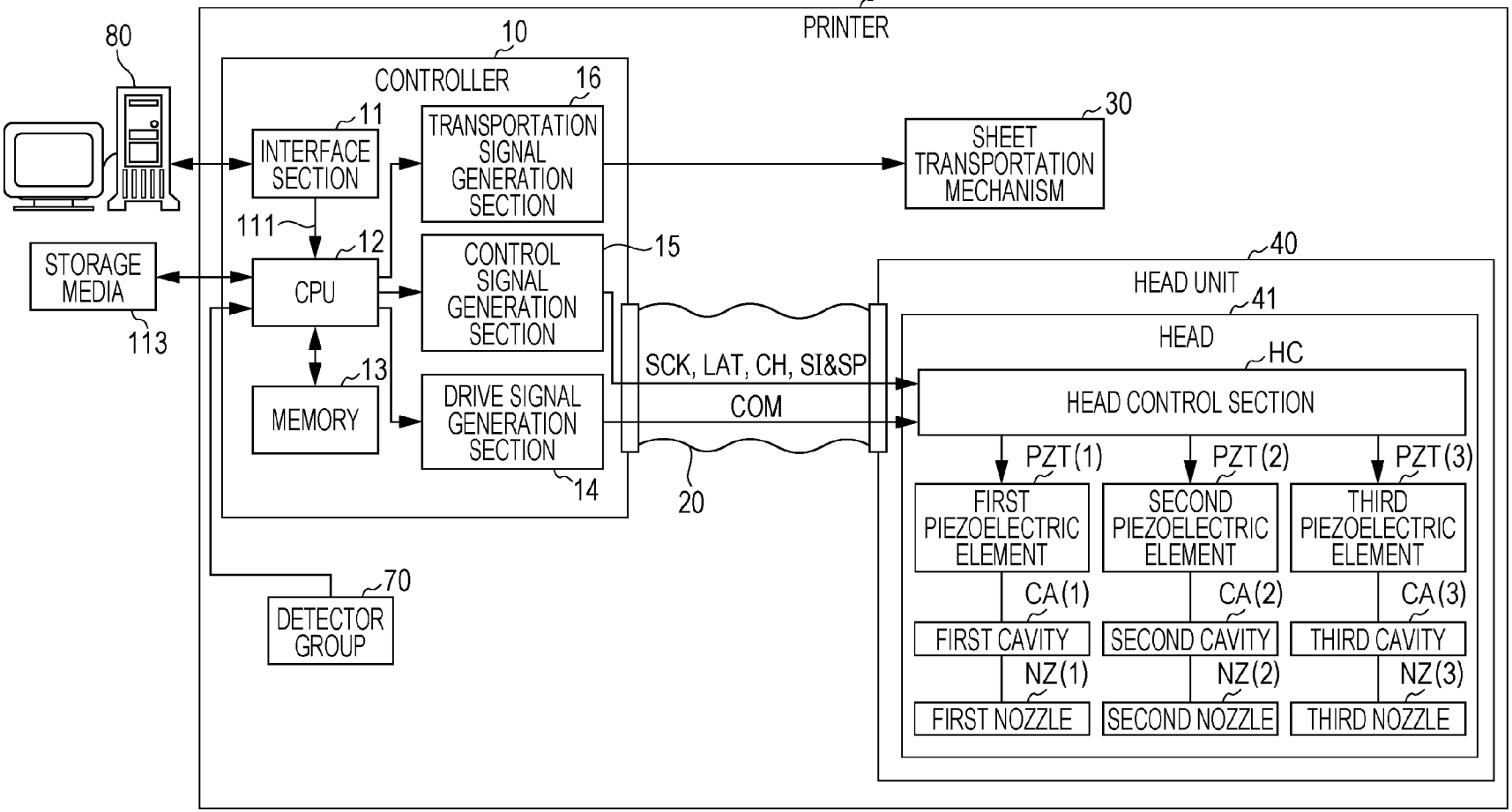
FIG. 1 is a block diagram illustrating an overall configuration of a printing system.

FIG. 1 is a block diagram illustrating an overall configuration of a printing system including a liquid ejecting-type printing apparatus (printer 1) of a first embodiment. As described below, the printer 1 is a line head printer in which a sheet S (refer to FIGS. 2 and 3) is transported in a predetermined direction and is printed in a printing region during the transportation thereof.

The printer 1 is connected to a computer 80 to be able to communicate with each other. A printer driver installed inside the computer 80 creates printing data to cause the printer 1 to print an image, and outputs the data to the printer 1. The printer 1 has a controller 10, a sheet transportation mechanism 30, a head unit 40 and a detector group 70. As described below, the printer 1 may include a plurality of head units 40. However, one head unit 40 will be described herein as a representative unit illustrated in FIG. 1.

The controller 10 inside the printer 1 performs overall controlling in the printer 1. An interface section 11 transceiver data with respect to the computer 80, which is an external apparatus. The interface section 11 outputs a piece of printing data 111 among pieces of data received from the computer 80 to a CPU 12. The printing data 111 includes image data, data designating a printing mode, and the like.

The CPU 12 is an arithmetic processing unit performing the overall controlling of the printer 1 and controls the head unit 40 and the sheet transportation mechanism 30 via a drive signal generation section 14, a control signal generation section 15 and a transportation signal generation section 16. A memory 13 secures a storage region or a working region for a program and data of the CPU 12. The detector group 70 monitors circumstances in the printer 1, and the controller 10 performs the controlling based on a detected result from the detector group 70. The program and the data of the CPU 12 may be stored in a storage medium 113. The storage medium 113 may be any one of a magnetic disk such as a hard disk, an optical disk such as a DVD, a nonvolatile memory such as a flash memory, and the like, without being particularly limited. As in FIG. 1, the CPU 12 may be accessible to the storage medium 113 which is connected to the printer 1. The storage medium 113 may be connected to the computer 80, and the CPU 12 may be accessible (route not illustrated) to the storage medium 113 via the interface section 11 and the computer 80.

The drive signal generation section 14 generates a drive signal COM displacing a piezoelectric element PZT which is included in a head 41. As described below, the drive signal generation section 14 includes a portion of an original drive signal generation section 25, a signal modulation section 26, a signal amplification section 28 (digital power amplification circuit), and a signal conversion section 29 (smooth filter) (refer to FIG. 7). The drive signal generation section 14 following instructions from the CPU 12 generates an original drive signal 125 in the original drive signal generation section 25, causes the original drive signal 125 to be pulse-modulated in the signal modulation section 26 to generate a modulation signal 126, amplifies the modulation signal 126 in the signal amplification section 28, and smoothes an amplification modulation signal 128 (amplified modulation signal 126) in the signal conversion section 29, thereby generating the drive signal COM.

The control signal generation section 15 following instructions from the CPU 12 generates a control signal. The control signal is a signal used for controlling the head 41, selecting a nozzle to eject a liquid, for example. In the embodiment, the control signal generation section 15 generates control signals including a clock signal SCK, a latch signal LAT, a channel signal CH and drive pulse selection data SI & SP, and these signals will be described below in detail. The control signal generation section 15 may be configured to be included in the CPU 12 (that is, a configuration in which the CPU 12 also performs a function of the control signal generation section 15).

The drive signal COM generated by the drive signal generation section 14 is an analog signal in which a voltage continuously changes. The control signals including the clock signal SCK, the latch signal LAT, the channel signal CH and the drive pulse selection data SI & SP are digital signals. The drive signal COM and the control signals are transmitted to the head 41 of the head unit 40 via a cable 20, that is, a flexible flat cable (hereinafter, also referred to as FFC). Regarding the control signal, a differential serial method may be used to transmit a plurality of types of the signals through time sharing. In this case, compared to a case of parallel transmission of the control signals classified by types, the number of transmission wire necessary can be reduced, thereby avoiding deterioration of a sliding property caused by many superposed FFC and causing a size of a connector provided in the controller 10 and the head unit 40 to be small.

The transportation signal generation section 16 following the instructions from the CPU 12 generates a signal to control the sheet transportation mechanism 30. The sheet transportation mechanism 30 rotatably supports the sheet S which is continuously wound in a roll shape, for example, and transports the sheet S by rotating, thereby printing a predetermined character, image or the like in the printing region. For example, the sheet transportation mechanism 30 transports the sheet S in a predetermined direction based on a signal generated in the transportation signal generation section 16. The transportation signal generation section 16 may be configured to be included in the CPU 12 (that is, a configuration in which the CPU 12 also performs a function of the transportation signal generation section 16).

The head unit 40 includes the head 41 as a liquid ejecting section. Due to limitations of space, only one head 41 is illustrated in FIG. 1. However, the head unit 40 according to the embodiment is regarded as having a plurality of heads 41. The head 41 has at least two actuator sections including the piezoelectric element PZT, a cavity CA and a nozzle NZ, and also includes a head control section HC controlling displacement of the piezoelectric element PZT. The actuator section includes the piezoelectric element PZT which is displaceable by the drive signal COM, the cavity CA which is filled with a liquid and in which an inside pressure is increased and decreased in accordance with the displacement of the piezoelectric element PZT, and a nozzle NZ which communicates with the cavity CA and ejects a liquid as a liquid droplet in accordance with the increase and decrease of a pressure inside the cavity CA. The head control section HC controls the displacement of the piezoelectric element PZT based on the drive signal COM and the control signal from the controller 10.

In order to distinguish elements included in each actuator section, a numeral in parenthesis is applied to the reference sign. In the example of FIG. 1, there are three actuator sections. A first actuator section includes a first piezoelectric element PZT(1), a first cavity CA(1) and a first nozzle NZ(1); a second actuator section includes a second piezoelectric element PZT(2), a second cavity CA(2) and a second nozzle NZ(2); and a third actuator section includes a third piezoelectric element PZT(3), a third cavity CA(3) and a third nozzle NZ(3). The actuator section may be two or four or more in number, for example, without being limited to being three. In FIG. 1, the first to third actuator sections are included in one head 41 for convenience of illustration. However, a portion of the actuators may be included in another head 41 (not illustrated).

The drive signal COM is generated in the drive signal generation section 14 as in FIG. 1, and transmitted to the first piezoelectric element PZT(1), the second piezoelectric element PZT(2) and the third piezoelectric element PZT(3) via the cable 20 and the head control section HC. The control signals including the clock signal SCK, the latch signal LAT, the channel signal CH and the drive pulse selection data SI & SP are generated in the control signal generation section 15 as in FIG. 1, and used for controlling in the head control section HC via the cable 20.

2. Configuration of Printer

Figure 2:
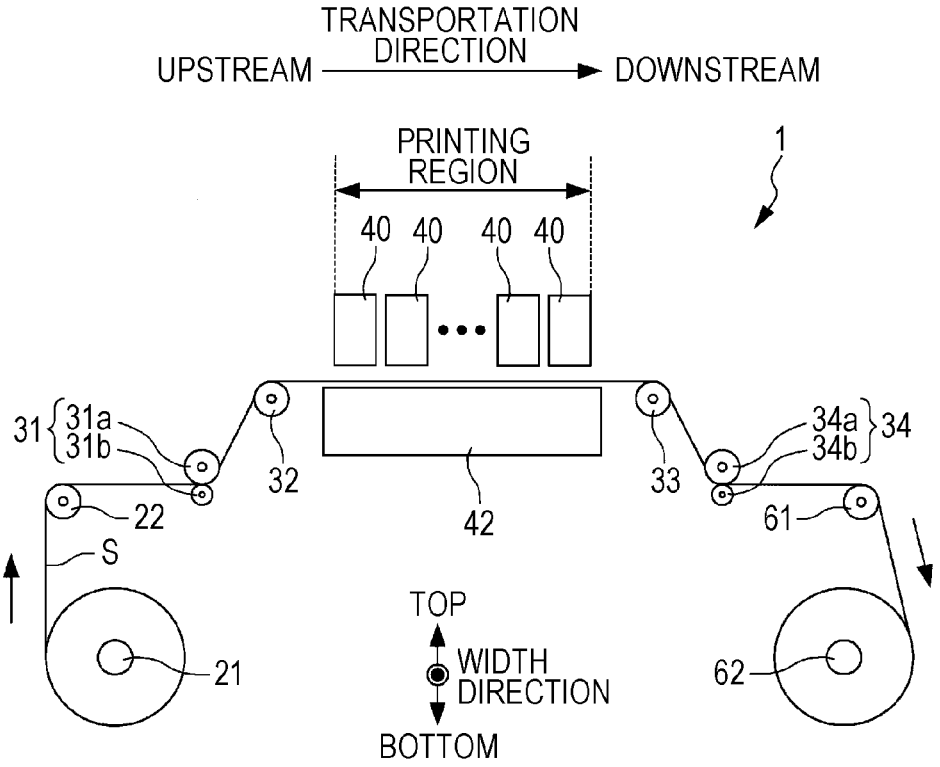
FIG. 2 is a schematic cross-sectional view of a printer.

FIG. 2 is a schematic cross-sectional view of the printer 1. In the example of FIG. 2, the sheet S is described as continuously wound paper in a roll shape. A recording medium on which the printer 1 prints an image may be cut paper, cloth, a film or the like, without being limited to the continuously wound paper.

The printer 1 has a feeding shaft 21 which feeds the sheet S by rotating, and a relay roller 22 which winds the sheet S fed from the feeding shaft 21 to be guided to a pair of upstream side transportation rollers 31. The printer 1 has a plurality of relay rollers 32 and 33 which wind and send the sheet S, the pair of upstream side transportation rollers 31 which are installed on an upstream side from the printing region in a transportation direction, and a pair of downstream side transportation rollers 34 which are installed on a downstream side from the printing region in the transportation direction. The pair of upstream side transportation rollers 31 and the pair of downstream side transportation rollers 34 respectively have driving rollers 31*a* and 34*a* connected to motors (not illustrated) for rotational driving, and driven rollers 31*b* and 34*b* rotating in accordance with rotations of the driving rollers 31*a* and 34*a*. A transportation force is applied to the sheet S in accordance with the rotational driving of the driving rollers 31*a* and 34*a* in a state where the pair of upstream side transportation rollers 31 and the pair of downstream side transportation rollers 34 respectively pinch the sheet S. The printer 1 has a relay roller 61 which winds and sends the sheet S sent from the pair of downstream side transportation rollers 34, and a winding driving shaft 62 which winds the sheet S sent from the relay roller 61. The printed sheet S is sequentially wound in a roll shape in accordance with the rotational driving of the winding driving shaft 62. The rollers or the motors (not illustrated) correspond to the sheet transportation mechanism 30 in FIG. 1.

The printer 1 has the head unit 40 and a platen 42 which supports the sheet S from an opposite side surface of a printing surface in the printing region. The printer 1 may include the plurality of head units 40. In the printer 1, for example, the head unit 40 may be prepared for each color of ink. The printer 1 may have a configuration in which four head units 40 which can eject inks in four colors, that is, yellow (Y), magenta (M), cyan (C) and black (B) are arranged in the transportation direction. In the description below, one head unit 40 is described as a representative unit. However, the colors of the ink are respectively allocated to the nozzles thereof, thereby making it possible to perform color printing.

Figure 3:
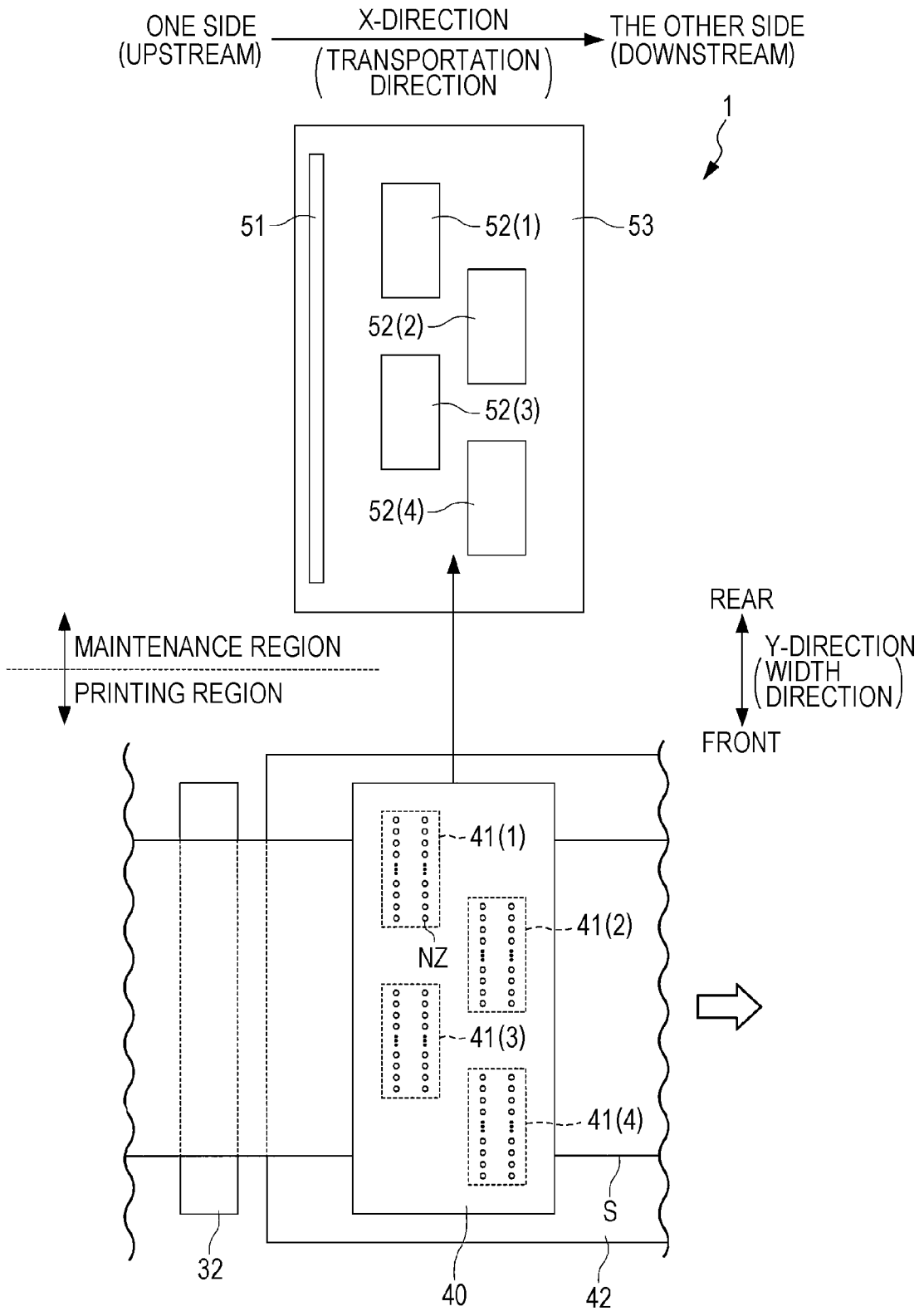
FIG. 3 is a schematic top view of the printer.

As illustrated in FIG. 3, in the head unit 40, a plurality of heads 41(1) to 41(4) are arranged in a width direction (Y-direction) of the sheet S intersecting with the transportation direction of the sheet S. For convenience of description, numbers are applied in an ascending order from the head 41 on a further rear side in the Y-direction. On a surface facing the sheet S (bottom surface) in each head 41, multiple nozzles NZ ejecting an ink are arranged at predetermined intervals in the Y-direction. FIG. 3 virtually illustrates positions of the heads 41 and the nozzles NZ when the head unit 40 is seen from the top. The positions of the nozzles NZ in end portions of the heads 41 adjacent to each other in the Y-direction (for example, 41(1) and 41(2)) overlap each other at least in a portion, and the nozzles NZ are arranged at predetermined intervals in the Y-direction across a length equal to or wider than the width of the sheet S on the bottom surface of the head unit 40. Therefore, the head unit 40 ejects an ink from the nozzle NZ to the sheet S which is transported under the head unit 40 without stopping, thereby printing a two-dimensional image on the sheet S.

In FIG. 3, due to limitations of space, the heads 41 which belong to the head unit 40 are illustrated as four, but the number is not limited thereto. In other words, the number of head 41 may be more or less than four. The heads 41 in FIG. 3 are disposed in a zigzag grid shape, but the disposition is not limited thereto. As a method of ejecting an ink from the nozzle NZ, a piezoelectric type is adopted in the embodiment in which an ink is ejected by applying a voltage to the piezoelectric element PZT to expand and extract an ink chamber. However, a thermal type may be adopted in which an ink is ejected by air bubbles generated inside the nozzle NZ using a heating element.

In the embodiment, the sheet S is supported on a horizontal surface of the platen 42, but without being limited thereto, for example, a rotation drum which rotates around a rotating shaft in the width direction of the sheet S may be caused to serve as the platen 42, thereby ejecting an ink from the head 41 while winding the sheet S around the rotation drum to be transported. In this case, the head unit 40 is obliquely disposed along an outer circumferential surface of an arc shape of the rotation drum. If the ink ejected from the head 41 is an UV ink which is cured by irradiating ultraviolet rays, an irradiator for irradiating ultraviolet rays may be provided on a downstream side of the head unit 40.

The printer 1 is provided with a maintenance region for cleaning the head unit 40. There exist a wiper 51, a plurality of caps 52 and an ink reception section 53 in the maintenance region of the printer 1. The maintenance region is positioned on a rear side in the Y-direction from the platen 42 (that is, printing region), and the head unit 40 moves to the rear side in the Y-direction while cleaning.

The wiper 51 and the caps 52 are supported by the ink reception section 53 to be movable in an X-direction (transportation direction of sheet S) by the ink reception section 53. The wiper 51 is a plate-shaped member erected in the ink reception section 53 and formed of an elastic member, cloth, felt and the like. The caps 52 are rectangular parallelepiped members formed of the elastic members and the like, and are provided in each head 41. The caps 52(1) to 52(4) are arranged in the width direction corresponding to the disposition of the heads 41(1) to 41(4) in the head unit 40. Accordingly, if the head unit 40 moves to the rear side in the Y-direction, the heads 41 and the caps 52 face each other, and then, if the head unit 40 is lowered (or if the caps 52 are lifted), the caps 52 respectively adhere to nozzle opening surfaces of the heads 41, thereby making it possible to seal the nozzle NZ. The ink reception section 53 also functions to receive an ink ejected from the nozzles NZ while cleaning the heads 41.

When an ink is ejected from the nozzle NZ provided in the heads 41, minute ink droplets are generated together with main ink droplets, and the minute ink droplets fly about as a mist, thereby adhering to the nozzle opening surfaces of the heads 41. Not only the ink, but dust, paper powder and the like also adhere to the nozzle opening surfaces of the heads 41. If these foreign substances are left behind and accumulate and adhere to the nozzle opening surfaces of the heads 41, the nozzles NZ are blocked, thereby hindering ejection of ink from the nozzles NZ. Therefore, in the printer 1 according to the embodiment, a wiping treatment is periodically carried out as the cleaning of the head unit 40.

3. Drive Signal and Control Signal

Hereinafter, the drive signal COM and the control signal transmitted from the controller 10 via the cable 20 will be described in detail. Initially, a structure of the heads 41 will be described, and after waveforms of the drive signal COM and the control signal are exemplified, a configuration of the head control section HC will be described.

3.1. Structure of Head

Figure 4:
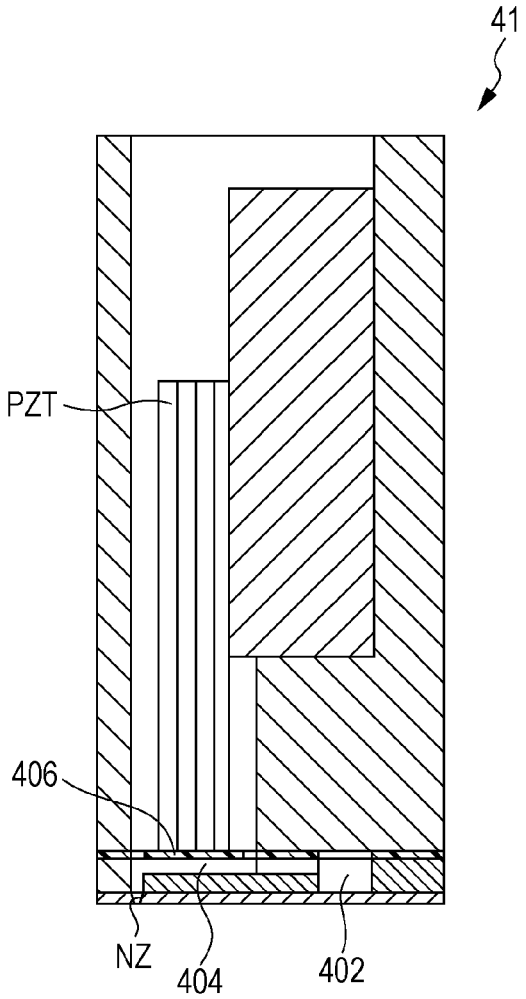
FIG. 4 is a diagram for describing a structure of a head.

FIG. 4 is a view for describing a structure of the head 41. The nozzle NZ, the piezoelectric element PZT, an ink supply channel 402, a nozzle communication channel 404 and an elastic plate 406 are illustrated in FIG. 4. The ink supply channel 402 and the nozzle communication channel 404 correspond to the cavity CA.

The ink droplets are supplied through the ink supply channel 402 from an ink tank (not illustrated). Then, the ink droplets are supplied to the nozzle communication channel 404. A drive pulse PCOM of the drive signal COM is applied to the piezoelectric element PZT. When the drive pulse PCOM is applied, the piezoelectric element PZT expands and extracts (is displaced) in accordance with a waveform, thereby vibrating the elastic plate 406. The ink droplets in an amount corresponding to amplitude of the drive pulse PCOM are ejected from the nozzle NZ. The actuator sections configured to have the nozzles NZ, the piezoelectric element PZT and the like are arranged as in FIG. 3, thereby configuring the heads 41 having the nozzle rows.

3.2. Waveform of Signal

Figure 5:
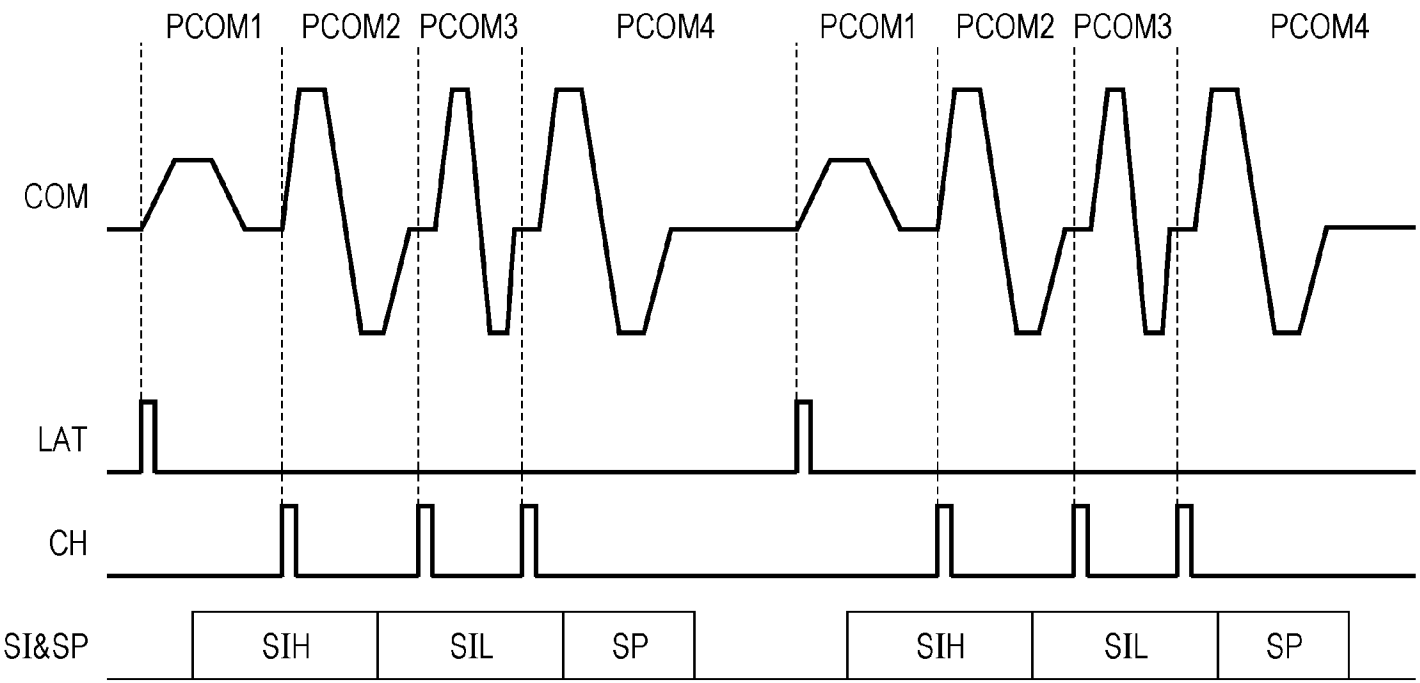
FIG. 5 is a diagram for describing a drive signal which is from a drive signal generation section, and a control signal which is used in forming dots.

FIG. 5 is a view for describing the drive signal COM which is from the drive signal generation section 14 and the control signal which is used in forming dots. The drive signal COM is obtained by chronologically connecting the drive pulses PCOM, that is, unit drive signals applied to the piezoelectric element PZT to eject a liquid. A rising portion of the drive pulse PCOM indicates a stage in which volume of the cavity CA communicating with the nozzle is expanded to draw a liquid in, and a falling portion of the drive pulse PCOM indicates a stage in which the volume of the cavity CA is contracted to push a liquid out. As a result of pushing out a liquid, the liquid is ejected from the nozzle.

A draw-in amount or a draw-in speed of a liquid and a push-out amount or a push-out speed of the liquid can vary by variously changing an inclination of the increase and decrease in voltage and a peak value of the drive pulse PCOM formed by a voltage trapezoidal wave. Accordingly, it is possible to obtain the dot having various sizes by changing an ejecting amount of a liquid. Therefore, even in a case of chronologically connecting the plurality of drive pulses PCOM, it is possible to obtain the dots having various sizes by selecting a single drive pulse PCOM therefrom to be applied to the piezoelectric element PZT, thereby ejecting a liquid, or by selecting a plurality of the drive pulses PCOM to be applied to the piezoelectric element PZT, thereby ejecting a liquid a plurality of times. In other words, if a plurality of liquids are caused to impact onto the same position before the liquids dry, substantially the same effect can be achieved as ejecting a large amount of liquid, and thus, the dot can be increased in size. It is possible to achieve multi-gradation by combining such technologies. A drive pulse PCOM 1 at the left end in FIG. 5 only draws a liquid in without pushing any out, which is different from drive pulses PCOM 2 to PCOM 4. This is called a minute vibration and is used for suppressing and preventing thickening at the nozzle without ejecting an ink.

The clock signal SCK, the latch signal LAT, the channel signal CH and the drive pulse selection data SI & SP are input to the head control section HC as the control signals from the control signal generation section 15, in addition to the drive signal COM from the drive signal generation section 14. The latch signal LAT and the channel signal CH among these are the control signals determining an instant of time for the drive signal COM. As in FIG. 5, a series of drive signals COM begin to be output by the latch signal LAT so that a drive pulse PCOM is output for each channel signal CH. Pieces of the drive pulse selection data SI & SP include pieces of the pixel data SI (SIH, SIL) for designating the piezoelectric element PZT corresponding to the nozzle which is to eject an ink droplet, as well as a piece of waveform pattern data SP of the drive signal COM. The reference signs SIH and SIL respectively correspond to a high-order bit and a low-order bit of the 2-bit pixel data SI.

3.3. Head Control Section

Figure 6:
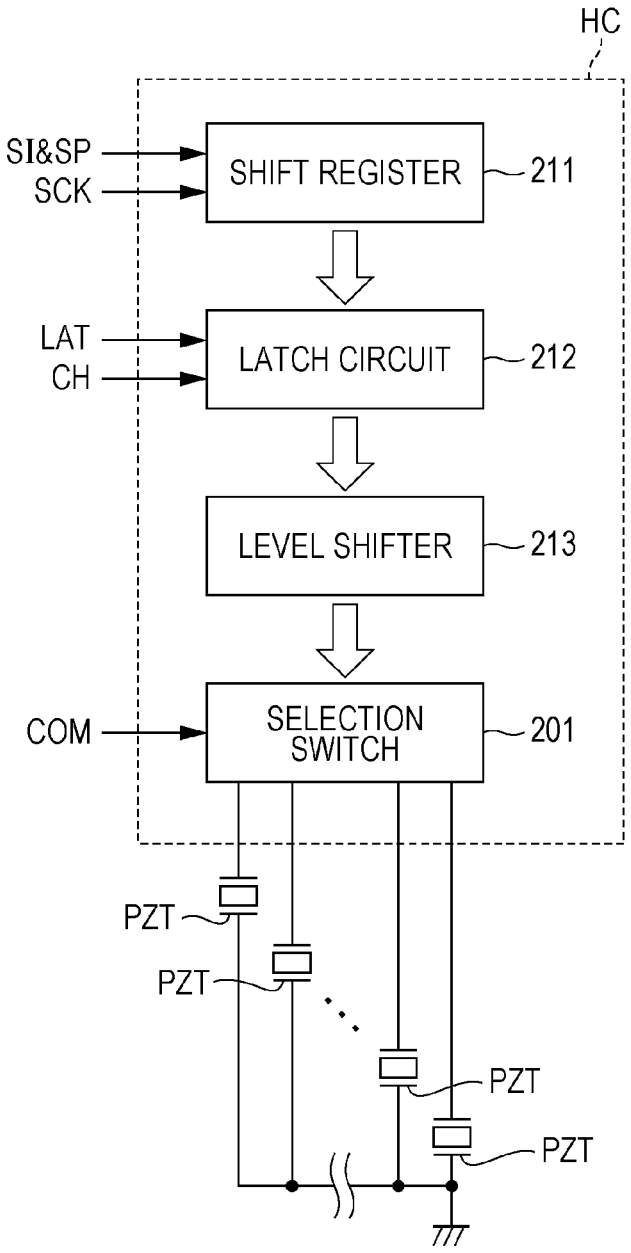
FIG. 6 is a block diagram describing a configuration of a head control section.

FIG. 6 is a block diagram describing a configuration of the head control section HC. The head control section HC is configured to have a shift register 211 which stores the drive pulse selection data SI & SP for designating the piezoelectric element PZT corresponding to the nozzle ejecting a liquid, a latch circuit 212 which temporarily stores data of the shift register 211, and a level shifter 213 which applies a voltage of the drive signal COM to the piezoelectric element PZT by converting a level of an output of the latch circuit 212 to supply to a selection switch 201.

The pieces of the drive pulse selection data SI & SP are sequentially input to the shift register 211, and a storage region is sequentially shifted from a first stage to latter stages in accordance with an input pulse of the clock signal SCK. The latch circuit 212 latches each output signal of the shift register 211 in response to the input latch signal LAT, after the pieces of the drive pulse selection data SI & SP are stored in the shift register 211 related to the corresponding the number of the nozzle. The signals stored in the latch circuit 212 are converted into a voltage level in which the selection switch 201 in a next stage can be turned on and off by the level shifter 213. This is because the drive signal COM is charged with a high voltage compared to an output voltage of the latch circuit 212 and a range of an operation voltage of the selection switch 201 is set high in accordance therewith. Therefore, the piezoelectric element PZT in which the selection switch 201 is closed by the level shifter 213 is connected to the drive signal COM (drive pulse PCOM) as a connection of the drive pulse selection data SI & SP.

After the drive pulse selection data SI & SP of the shift register 211 is stored in the latch circuit 212, subsequent printing information is input to the shift register 211, thereby sequentially updating the stored data of the latch circuit 212 during an ejection of a liquid. Even after causing the piezoelectric element PZT to be separated from the drive signal COM (drive pulse PCOM), this selection switch 201 allows the input voltage of the piezoelectric element PZT to maintain the voltage immediately before being separated therefrom.

3.4. Drive Signal

Figure 7:
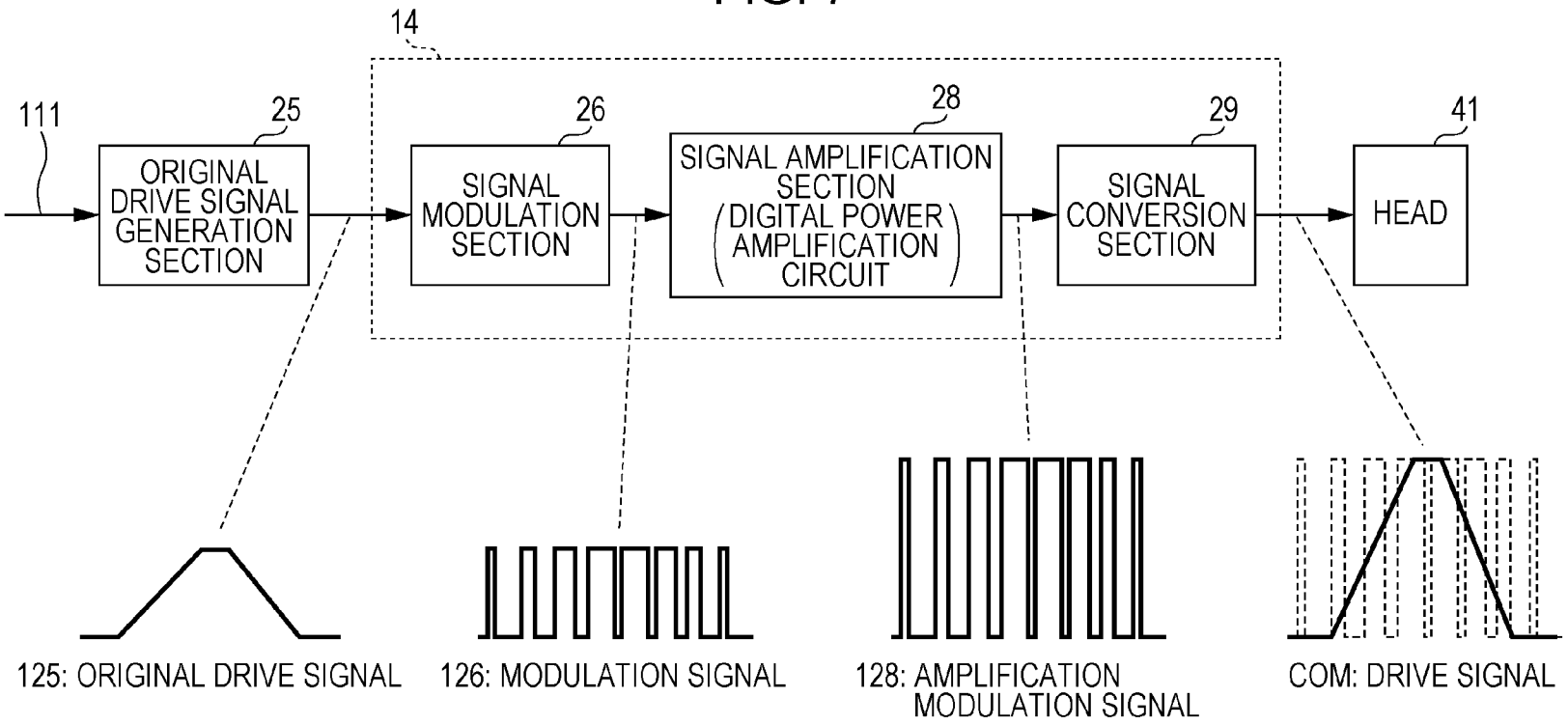
FIG. 7 is a diagram describing a flow up to generation of the drive signal.

FIG. 7 is a view describing a flow for explaining generation of the drive signal COM. As described above, the portion of the original drive signal generation section 25, the signal modulation section 26, the signal amplification section 28 (digital power amplification circuit), and the signal conversion section 29 (smooth filter) in FIG. 7 correspond to the drive signal generation section 14. The original drive signal generation section 25 generates the original drive signal 125 as in FIG. 7, for example, based on the printing data 111 from the interface section 11.

The original drive signal generation section 25 includes the CPU 12, a DAC 39 and the like as described below, and the CPU 12 selects original drive data based on the printing data 111 to output to the DAC 39, thereby generating the original drive signal 125.

The signal modulation section 26 performs a predetermined modulation to generate the modulation signal 126 when the original drive signal 125 is received from the original drive signal generation section 25. In the example, a predetermined modulation is the pulse-width modulation (PWM). However, another modulation method such as a pulse-density modulation (PDM) may be used, for example.

The signal amplification section 28 receives the modulation signal 126 and performs power amplification. The signal conversion section 29 smoothes the amplification modulation signal 128 and generates the analog drive signal COM in which a portion modulated in a wide pulse-width has a high voltage value and a portion modulated in a narrow pulse-width has a low voltage value.

4. Temperature Detection Section 4.1. Regarding Temperature Detection

Figure 8:
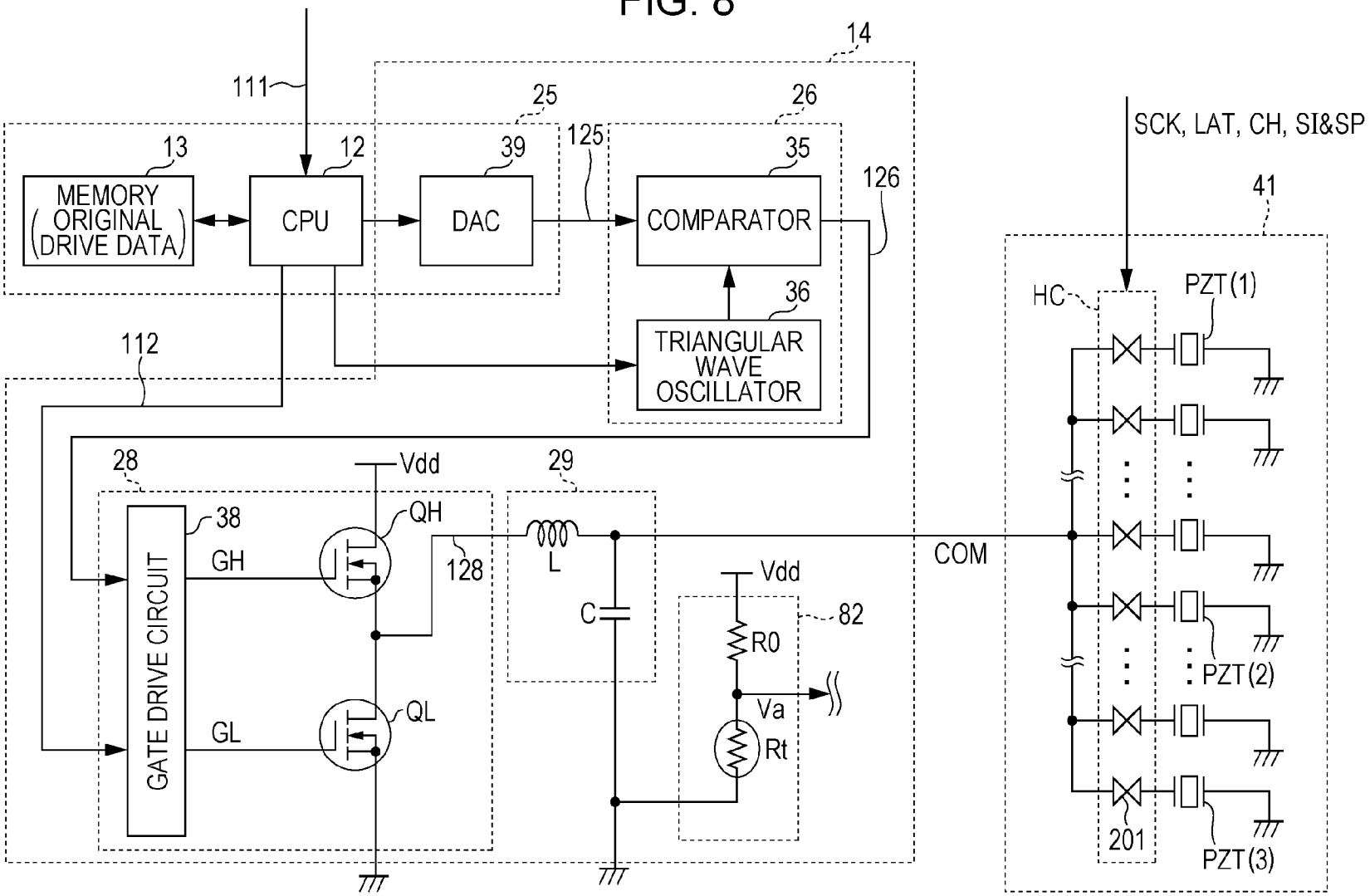
FIG. 8 is a detailed block diagram of the drive signal generation section including a temperature detection section.

FIG. 8 is a detailed block diagram of the drive signal generation section 14 and the like including the temperature detection section 82. The same reference numeral and sign are applied to the same element as that in FIGS. 1 to 7, and the description thereof will be omitted. A configuration of the signal conversion section 29 will be described with reference to FIG. 8. The signal conversion section 29 is realized as a low-pass filter in which a coil L and a capacitor C are combined.

Here, the printer 1 according to the embodiment is a line head printer in which a large number of nozzles are simultaneously driven. Since the drive signal COM needs to be applied to a large number of piezoelectric elements PZT, the coil L receives an extremely large load, and heat generation of the coil L becomes a major disadvantage. Thus, heat generation of the coil L causes the resistance value and the inductance of the coil L to change, thereby resulting in changes of characteristics of the drive signal COM which is restored through the coil L. When the characteristics of the drive signal COM change, a pressure change of the cavity CA which has changed by the operation of the piezoelectric element PZT also changes. Eventually, the amount of liquid droplets ejected from nozzles NZ changes, thereby causing deterioration of image quality.

In the printer 1 according to the embodiment, the above-described disadvantage is solved by including the temperature detection section 82 as in FIG. 8. The temperature detection section 82 is configured to have a thermistor Rt of which one end is grounded and a resistance R0 of which one end is connected to a supply voltage Vdd, being connected in series. The thermistor Rt may be a negative temperature coefficient (NTC) thermistor in which resistance decreases with respect to the rise of the temperature as in the embodiment, or in contrast, the thermistor Rt may be a positive temperature coefficient (PTC) thermistor in which the resistance increases with respect to the rise of the temperature.

The temperature detection section 82 outputs an electrical potential of the thermistor Rt on the terminal side which is not grounded as a detected temperature signal Va. The detected temperature signal Va is given through an expression of "Vdd×Rt/(R0+Rt)". The resistance values of the resistance R0 and the thermistor Rt are respectively indicated as R0 and Rt. The detected temperature signal Va is low since the value Rt decreases when the temperature rises. The detected temperature signal Va is high since the value Rt increases when the temperature falls. Accordingly, it is possible to know the temperature change of the subject of which the temperature is detected by the temperature detection section 82, in response to the change of the detected temperature signal Va.

Here, the signal conversion section 29 is subjected to the temperature detection by the temperature detection section 82. Particularly, the temperature of the capacitor C is detected. As in FIG. 8, the thermistor Rt of the temperature detection section 82 is also electrically connected to one end of the capacitor C. At least one among the original drive signal generation section 25, the signal modulation section 26, and the signal amplification section 28 executes an operation (for example, the stopping or the correction of an operation in order to generate the drive signal COM, hereinafter, referred to as "operation in response to the temperature") in response to the temperature of the signal conversion section 29 (particularly, the capacitor C), based on the detected temperature signal Va. The detailed description regarding the operation in response to the temperature will be given later. Herein, configurations of the original drive signal generation section 25, the signal modulation section 26, and the signal amplification section 28 will be described in detail with reference to FIG. 8.

The original drive signal generation section 25 includes the memory 13, the CPU 12, and one DAC 39. The memory 13 stores the original drive data of the original drive signal 125 which is configured to have digital potential data and the like. The CPU 12 reads the original drive data from the memory 13 based on the printing data 111 which is from the interface section 11, converts the original drive data into voltage signals, holds as many of the converted voltage signals as the quantity for a predetermined sampling period is, and instructs a frequency or a waveform of a triangular wave signal or waveform output timing toward a triangular wave oscillator 36 described below. The DAC 39 converts the voltage signal which is output from the CPU 12 into an analog signal and outputs the analog signal as the original drive signal 125.

The signal modulation section 26 is a pulse width modulation (PWM) circuit, and includes the triangular wave oscillator 36 and a comparator 35. The triangular wave oscillator 36 outputs a triangular wave signal as a reference signal in accordance with a frequency, a waveform, and waveform output timing instructed from the CPU 12. The comparator 35 compares the original drive signal 125 which is output from the DAC 39 and the triangular wave signal which is output from the triangular wave oscillator 36. The signal modulation section 26 outputs the modulation signal 126 of a pulse duty which becomes on-duty when the original drive signal 125 is larger than the triangular wave signal. Besides the signal modulation section 26 thereof, it is possible to use a known pulse modulation circuit such as the pulse-density modulation (PDM) circuit.

The signal amplification section 28 is the digital power amplification circuit, and is configured to have a half-bridge output stage consisting of a switching element QH on a higher side and a switching element QL on a lower side for amplifying power practically, and a gate drive circuit 38 for adjusting gate input signals GH and GL of the switching element QH on the higher side and the switching element QL on the lower side based on the modulation signal 126 from the signal modulation section 26. For example, a power MOSFET can be used as the switching elements QH and QL, and the switching element is not limited thereto.

In the signal amplification section 28, when the modulation signal 126 is at a high level, a gate input signal GH of the switching element QH on the higher side is at a high level, and a gate input signal GL of the switching element QL on the lower side is at a low level. Therefore, the switching element QH on the higher side is in an ON-state and the switching element QL on the lower side is in an OFF-state. As a result, an output from the half bridge output stage becomes the supply voltage Vdd. On the contrary, when the modulation signal 126 is at a low level, the gate input signal GH of the switching element QH on the higher side is at a low level, and the gate input signal GL of the switching element QL on the lower side is at a high level. Therefore, the switching element QH on the higher side is in the OFF-state and the switching element QL on the lower side is in the ON-state. As a result, an output from the half bridge output stage becomes zero.

When an amplification instruction signal 112 output from the CPU 12 gives an instruction to stop an operation, the gate drive circuit 38 causes both the switching element QH on the higher side and the switching element QL on the lower side to be in the OFF-state. Causing both the switching element QH on the higher side and the switching element QL on the lower side to be in the OFF-state is synonymous with stopping the operation of the signal amplification section 28. Thus, an actuator consisting of the piezoelectric elements PZT which are electrically capacitive loads is maintained in a high impedance state.

As described above, the signal conversion section is a smooth filter which attenuates and removes a modulation frequency, that is, a frequency component of the pulse modulation generated in the signal modulation section 26, and then, the signal conversion section 29 generates the drive signal COM and outputs the drive signal COM to the head 41 of the head unit 40.

The head 41 which receives the drive signal COM includes a large number of piezoelectric elements PZT corresponding to the nozzles ejecting liquids. The first piezoelectric element PZT(1), the second piezoelectric element PZT(2), and the third piezoelectric element PZT(3) are portions out of the entire piezoelectric elements PZT (for example, several thousand). The head 41 includes the head control section HC. The head control section HC includes the selection switch 201 which selects whether to apply a voltage of the drive signal COM or not to each of the piezoelectric elements PZT. In FIG. 8, the illustration of the cavity CA, the nozzles NZ, and functional blocks (for example, shift register 211, refer to FIG. 6) of the head control section HC other than the selection switch 201 is omitted.

4.2. Regarding Operation in Response to Temperature

As described above, at least one among the original drive signal generation section 25, the signal modulation section 26, and the signal amplification section 28 executes "the operation in response to the temperature", based on the detected temperature signal Va. Accordingly, damage to the components can be avoided and the ejecting stability can be achieved.

As "the operation in response to the temperature", stopping of the operation for generating the drive signal COM can be exemplified. Based on the detected temperature signal Va, when the temperature of the capacitor C is determined to exceed a predetermined temperature based on a rated temperature range (hereinafter, referred to as determination of the damage-inducing high temperature), at least one (any one) among the original drive signal generation section 25, the signal modulation section 26, and the signal amplification section 28 stops the operation. For example, when any one thereamong stops the operation for generating the drive signal COM, the temperature falls, and thus, damage to the capacitor C can be prevented. The determination of the damage-inducing high temperature may be performed by each of the original drive signal generation section 25, the signal modulation section 26, and the signal amplification section 28. Otherwise, for example, the CPU 12 may perform the determination of the damage-inducing high temperature, thereby outputting the result of the determination to the original drive signal generation section 25, the signal modulation section 26, and the signal amplification section 28.

The temperature detection section 82 having the coil L as a temperature detecting subject may perform the determination of the damage-inducing high temperature with respect to the coil L. However, in the embodiment, since heat dissipation of the coil L is enhanced by providing a large number of through holes TH (refer to FIG. 10) on the rear surface of the coil L on the substrate, the capacitor C in which damage is relatively likely to become a disadvantage is subjected to the temperature detection.

Subsequently, as "the operation in response to the temperature", correction of the operation for generating the drive signal COM can be exemplified. The data regarding the distortion of the waveform of the drive signal COM due to the change of the temperature can be obtained through a theoretical calculation, a simulation, actual measurement, and the like. Accordingly, in the original drive signal generation section 25, the signal modulation section 26, and the signal amplification section 28, the distortion of the waveform can be corrected based on the detected temperature signal Va.

Figure 9:
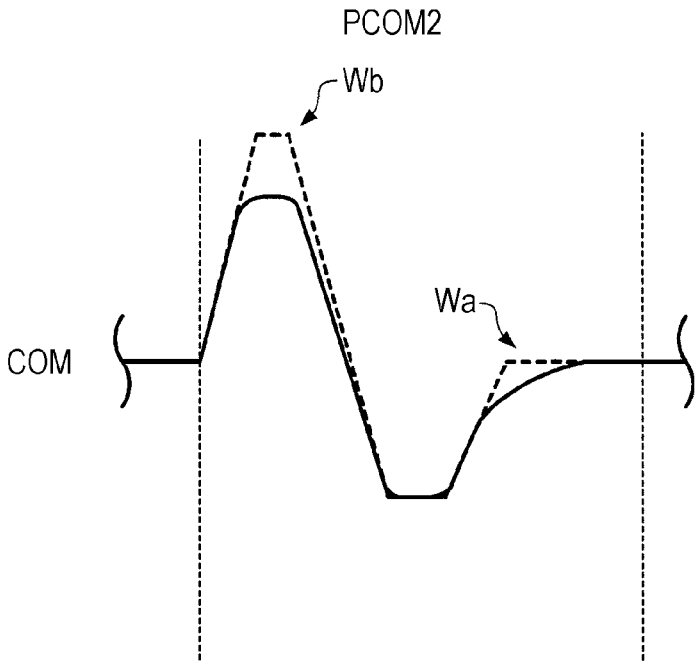
FIG. 9 is a diagram illustrating an example of deterioration of the drive signal caused by a rise in temperature in a present embodiment.

FIG. 9 is a diagram illustrating an example of deterioration of the drive signal COM caused by a rise in temperature. In FIG. 9, only the waveform corresponding to PCOM 2 of FIG. 5 is extracted to be illustrated. The waveform indicated by the dotted line is an ideal waveform corresponding to PCOM 2 of FIG. 5. The waveform having the distortion generated due to a rise in temperature is indicated by the solid line.

Initially, deterioration of the drive signal COM caused by a drop of a cut-off frequency Fc can be taken into consideration. When the temperature rises, the inductance of the coil L increases, and the cut-off frequency Fc of the signal conversion section 29, that is the low-pass filter, drops. Therefore, as in Wa of FIG. 9, the drive signal COM to be applied to the piezoelectric element PZT becomes blunt, and thus, there appears to be a lot of high frequency noise during the switching in the signal amplification section 28 (digital power amplification circuit).

When the blunt drive signal COM is applied to the piezoelectric element PZT, expanding or contracting of the volume of the cavity CA is not appropriately performed, thereby causing a possibility of an occurrence of tailing liquid droplets or satellite liquid droplets. Here, the tailing liquid droplets are caused by the ejected liquid droplets deformed in shapes extending toward the nozzle side. The satellite liquid droplets are small liquid droplets when the liquid droplets ejected from the nozzle are separated into liquid droplet main bodies and small liquid droplets. The tailing liquid droplets and the satellite liquid droplets cause a mixture of color in multi-color printing so that appropriate images are not formed, thereby resulting in deterioration of the quality of a generated product. When the drive signal COM having a lot of noise is applied to the piezoelectric element PZT, the very operation of the piezoelectric element PZT becomes unstable, thereby leading to erroneous ejecting.

Deterioration in which amplitude of the drive signal COM decreases as the resistance value of the coil L increases can be taken into consideration. Therefore, as in Wb of FIG. 9, the necessary time for changing the signal changes from $T_{b0}$ which is before deterioration occurs to $T_{b1}$, thereby changing the inclination of the increase and decrease of a voltage in the drive signal COM. The amount of the drawn-in liquid changes in response to the change of the inclination, thereby causing deterioration of the quality of a generated product. Here, in at least one (any one) among the original drive signal generation section 25, the signal modulation section 26, and the signal amplification section 28, the distortion of the waveform indicated by Wa and Wb of FIG. 9 is corrected to the waveform indicated by the dotted line of FIG. 9, based on the detected temperature signal Va.

In this case, the original drive signal generation section 25 may perform the correction. The correction of the operation of the original drive signal generation section 25 denotes that the waveform of the original drive signal 125 is changed, for example. In other words, the correction (pre-emphasis) in which an attenuated frequency is emphasized by the original drive signal 125 in accordance with the characteristics of the frequency attenuation of the drive signal COM in response to the temperature change is performed.

The signal modulation section 26 may perform the correction. The correction of the operation of the signal modulation section 26 denotes a drop of the modulation frequency, for example. It is because the load applied to the coil L can be decreased by dropping the modulation frequency.

The signal amplification section 28 may perform the correction. The correction of the operation of the signal amplification section 28 denotes a change of the amplification factor, for example. It is because the load applied to the coil L can be decreased by lowering the voltage. The correction of the original drive signal generation section 25, the signal modulation section 26, and the signal amplification section 28 may be performed through appropriate combination thereof. The correction may also be performed by appropriately combining with the stopping of the operation for generating the drive signal COM based on the result of the determination of the damage-inducing high temperature. Here, the distortion of the waveform indicated by Wa and Wb of FIG. 9 is an example, and there may be distortion in which the amplitude of the drive signal COM increases, for example. In such a case, at least one among the original drive signal generation section 25, the signal modulation section 26, and the signal amplification section 28 can be corrected to the waveform indicated by the dotted line of FIG. 9 through the above-described method.

4.3. Regarding Arrangement on Substrate

Figure 10:
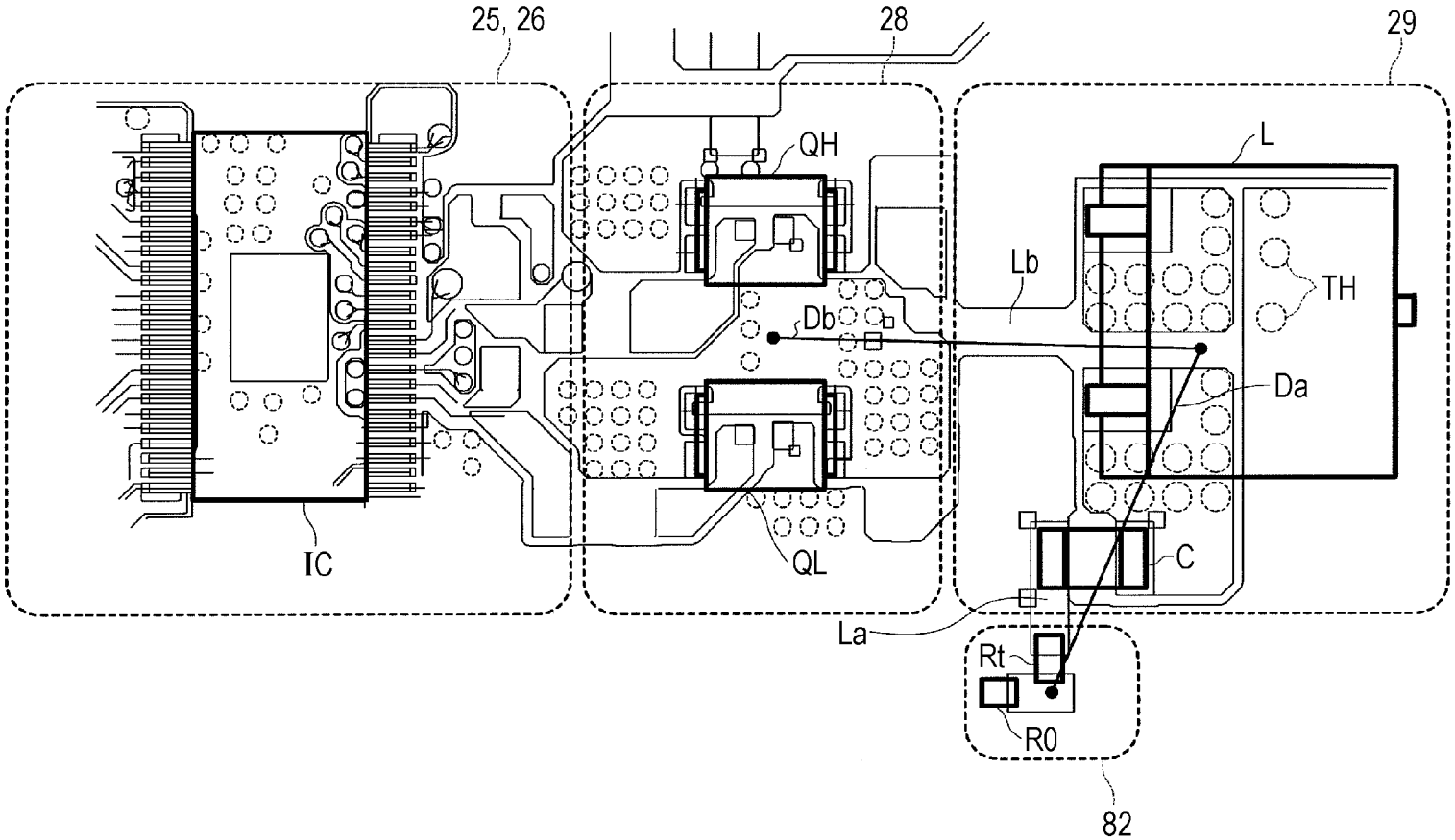
FIG. 10 is a diagram illustrating an example of physical arrangement of the temperature detection section and the like on a substrate.

Here, in order to make the temperature detection section 82 accurately detect the temperature of the capacitor C of the signal conversion section 29, it is preferable to be arranged on the substrate as illustrated in FIG. 10. FIG. 10 is a drawing illustrating an example of a physical arrangement of the temperature detection section 82 and the like on the substrate.

In FIG. 10, an integrated circuit device IC, the switching elements QH and QL, the coil L, the capacitor C, the thermistor Rt, and the resistance R0 are illustrated as the components, but the illustration of other components is omitted to allow easy recognition.

In FIG. 10, the substrate is broadly divided into four regions, such as a region of the original drive signal generation section 25 and the signal modulation section 26 having the integrated circuit device IC as the main component, a region of the signal amplification section 28 having the switching elements QH and QL as the main components, a region of the signal conversion section 29 including the coil L and the capacitor C, and a region of the temperature detection section 82 including the thermistor Rt and the resistance R0. In the embodiment, the region of the temperature detection section 82 (hereinafter, simply referred to as the temperature detection section 82), in order to accurately detect the temperature of the capacitor C, satisfies the following conditions upon the relationships with the region of the signal amplification section 28 (hereinafter, simply referred to as the signal amplification section 28) and the region of the signal conversion section 29 (hereinafter, simply referred to as the signal conversion section 29).

Initially, as in FIG. 10, a length La of a path which electrically connects between the signal conversion section 29 and the temperature detection section 82 is shorter than a length Lb of a path which electrically connects between the signal conversion section 29 and the signal amplification section 28. In this case, noise of other signals caused by the operation (for example, switching operation) of the signal amplification section 28 can be removed within a possible range by shortening the length La of a path between the signal conversion section 29 and the temperature detection section 82. Moreover, it is possible to decrease the influence of other heat generation sources (for example, switching elements QH and QL) in the signal amplification section 28 within a possible range.

As in FIG. 10, a physical straight-line distance Da between the signal conversion section 29 and the temperature detection section 82 is shorter than a physical straight-line distance Db between the signal conversion section 29 and the signal amplification section 28. In this case, it is possible to enhance the effect of removing noise of other signals caused by the operation (for example, switching operation) of the signal amplification section 28 by shortening the physical straight-line distance Da between the signal conversion section 29 and the temperature detection section 82. In FIG. 10, the physical straight-line distances Da and Db are determined by connecting the physical centers of the signal amplification section 28, the signal conversion section 29, and the temperature detection section 82. However, for example, the physical straight-line distances Da and Db may be determined by connecting the main components (for example, the switching elements QH and QL, the coil L, and the thermistor Rt).

As described above, in the printer 1 according to the embodiment, ejecting stability can be achieved and damage to the components can be avoided by causing the temperature detection section 82 to detect the temperature of the signal conversion section 29. The ejecting stability can be realized by correcting the distortion of the drive signal COM in response to the temperature. In this case, it is possible to avoid the change of the amount of liquid droplets ejected from the nozzle caused by the temperature change and to avoid deterioration of the quality of a generated product. Regarding the avoidance of damage to components, for example, damage to the capacitor C can be avoided by performing the determination of the damage-inducing high temperature and stopping the generation of the drive signal COM based on the result of the determination. Accordingly, it is possible to provide the printer 1 and the head unit 40 in which deterioration of the long-term quality (for example, life duration) can be avoided.

The embodiment is not limited to the liquid ejecting apparatuses adopting the line head method. It is possible to achieve the same effect as long as the liquid ejecting apparatus is a liquid ejecting-type printing apparatus in which a demand for simultaneously driving a large number of piezoelectric elements is conceived.

5. Others

The aspects of the invention include substantially the same configuration (for example, a configuration having the same function, method and result; or a configuration having the same goal and effect) as the configuration described in the examples and applications. The aspects of the invention also include a configuration of which a portion that is nonessential in the configuration described in the embodiments and the like is replaced. The aspects of the invention further include a configuration exhibiting the same operation effect or a configuration through which the same goal can be achieved, as the configuration described in the embodiments and the like. The aspects of the invention also include a configuration in which a known technology is added to the configuration described in the embodiments and the like.

What is claimed is:

1. A liquid ejecting apparatus comprising:

an original drive signal generation section that generates an original drive signal;

a signal modulation section that modulates the original drive signal and generates a modulation signal;

a signal amplification section that amplifies the modulation signal and generates an amplification modulation signal;

a signal conversion section that converts the amplification modulation signal into a drive signal;

a piezoelectric element that deforms by the drive signal;

a cavity that expands or contracts due to deformation of the piezoelectric element;

a nozzle that communicates with the cavity and ejects a liquid in response to increase and decrease of a pressure inside the cavity; and a temperature detection section that detects a temperature of the signal conversion section, wherein a length of a path that electrically connects between the signal conversion section and the temperature detection section is shorter than a length of a path that electrically connects between the signal conversion section and the signal amplification section.

2. The liquid ejecting apparatus according to claim 1, wherein an operation of any one among the original drive signal generation section, the signal modulation section, and the signal amplification section is stopped in response to the temperature detected by the temperature detection section.

3. The liquid ejecting apparatus according to claim 1, wherein an operation of any one among the original drive signal generation section, the signal modulation section, and the signal amplification section is corrected in response to the temperature detected by the temperature detection section.

4. The liquid ejecting apparatus according to claim 1, wherein there are a plurality of piezoelectric elements, and wherein the drive signal is applied to the plurality of piezoelectric elements.

5. The liquid ejecting apparatus according to claim 1, wherein the liquid ejecting apparatus is a line head printer.

6. A liquid ejecting apparatus comprising:

an original drive signal generation section that generates an original drive signal;

a signal modulation section that modulates the original drive signal and generates a modulation signal;

a signal amplification section that amplifies the modulation signal and generates an amplification modulation signal;

a signal conversion section that converts the amplification modulation signal into a drive signal;

a piezoelectric element that deforms by the drive signal;

a cavity that expands or contracts due to deformation of the piezoelectric element;

a nozzle that communicates with the cavity and ejects a liquid in response to increase and decrease of a pressure inside the cavity; and a temperature detection section that detects a temperature of the signal conversion section, wherein a physical straight-line distance of a path between the signal conversion section and the temperature detection section is shorter than a physical straight-line distance of a path between the signal conversion section and the signal amplification section.

* * * * *